US007100408B2

(12) United States Patent
Nakasone

(10) Patent No.: US 7,100,408 B2
(45) Date of Patent: Sep. 5, 2006

(54) FRONT LOADING LOCK ASSEMBLY

(75) Inventor: Franklin T. Nakasone, Aliso Viejo, CA (US)

(73) Assignee: Newfrey, LLC, Newark, DE (US)

( * ) Notice: Subject to any disclaimer, the term of this patent is extended or adjusted under 35 U.S.C. 154(b) by 0 days.

(21) Appl. No.: 10/790,964

(22) Filed: Mar. 2, 2004

(65) Prior Publication Data

US 2005/0193786 A1 Sep. 8, 2005

(51) Int. Cl.
*E05B 9/04* (2006.01)

(52) U.S. Cl. ..... 70/375; 70/367; 70/370; 70/371

(58) Field of Classification Search ..... 70/367–371, 70/373–375, 451
See application file for complete search history.

(56) References Cited

U.S. PATENT DOCUMENTS 2,021,241 A * 11/1935 Mall ..... 285/276
2,948,141 A * 8/1960 Vahlstrom ..... 70/370
3,429,154 A * 2/1969 Schwartz ..... 70/375
4,099,397 A * 7/1978 Dauenbaugh ..... 70/371
4,866,964 A * 9/1989 Hall ..... 70/369
5,038,589 A * 8/1991 Martin ..... 70/368
5,121,619 A * 6/1992 Martin ..... 70/371
5,410,899 A * 5/1995 McConnell ..... 70/370
5,636,540 A * 6/1997 Myers ..... 70/370
5,884,512 A 3/1999 Wayne
5,907,963 A * 6/1999 Myers et al. ..... 70/371
5,931,035 A * 8/1999 Bolton ..... 70/367
6,079,241 A * 6/2000 Burleigh et al. ..... 70/370
6,202,457 B1 3/2001 Hsueh et al.
6,301,942 B1 10/2001 Shvarts
6,393,882 B1 * 5/2002 Higgins ..... 70/370
6,523,378 B1 * 2/2003 Kuo ..... 70/360
6,568,229 B1 * 5/2003 Heinrich ..... 70/370
6,604,392 B1 8/2003 Kiso et al.
6,637,243 B1 10/2003 Lemley et al.

* cited by examiner

*Primary Examiner*—Suzanne Dino Barrett
(74) *Attorney, Agent, or Firm*—Carlson, Gaskey & Olds

(57) ABSTRACT

A lock assembly includes a housing, a core assembly and a retainer. The housing includes a housing retainer groove located generally transverse to an axis defined by a bore through the housing, which corresponds with a core retainer groove. When the core assembly is mounted within the bore, the retainer grooves are aligned. The retainer is inserted into the grooves such that a bridge portion of the retainer is engaged by an engagement feature to secure the retainer and thereby mount the core assembly into the housing.

10 Claims, 4 Drawing Sheets

FRONT LOADING LOCK ASSEMBLY

BACKGROUND OF THE INVENTION

The present invention relates to a lock assembly, and more particularly to a mounting arrangement for a core assembly into a lock housing.

Numerous types of conventional lock assemblies are utilized for various applications.

Homes and commercial establishments are protected predominantly by key-actuated pin tumbler locks. In a typical lock, a core assembly houses a rotational cylindrical plug having a longitudinally extending keyway. A driving member such as a cam is connected to the rear face of the plug. The driving member actuates a bolt-throwing or latch-moving mechanism.

The interface between the plug and the core is called the shear line. A plurality of radially extending, parallel chambers is formed in the core and the plug. Spring-biased pins are disposed in each chamber. Under normal conditions, the drivers block the shear line, to prevent the plug from being rotated relative to the core. However, when a properly configured key is inserted into the keyway, the drivers and lower pins are moved so that the top of the lower pins and the bottom of the drivers meet at the shear line. The plug can then be rotated to cause rotation of the driving member and subsequent retraction or extension of the bolt or latch.

Locksmiths frequently rekey or replace residential or commercial locks. To this end, interchangeable core assemblies are manufactured by various lockmakers.

Disadvantageously, the interchangeable core assemblies are relatively complicated.

Typically, the interchangeable core assembly, even those from a single manufacturer, is specific to a particular lock type and include mounting structure specific thereto. For example, a knob lock assembly, a lever lock assembly, and deadbolt lock assembly each utilize a core assembly particular to a knob, a lever, and a deadbolt respectively. Such an arrangement complicates rekeying and replacement of residential and commercial locks.

Accordingly, it is desirable to provide mounting arrangement for a core assembly that is readily mounted into multiple lock types.

SUMMARY OF THE INVENTION

The lock assembly according to the present invention includes a housing, a core assembly, and a retainer. The housing supports and protects the core assembly. The retainer is a generally flat U-shaped member with two legs and a bridge portion therebetween.

The housing includes a housing retainer groove located generally transverse to an axis defined by a bore through the housing. The housing retainer groove corresponds with a core retainer groove. When the core assembly is mounted within the bore, the retainer grooves are aligned. The retainer is inserted into the grooves such that the bridge portion is engaged by an engagement feature to secure the retainer into the grooves and thereby mount the core assembly into the housing.

The present invention therefore provides an uncomplicated mounting arrangement for a core assembly, which is readily mounted into multiple lock types.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
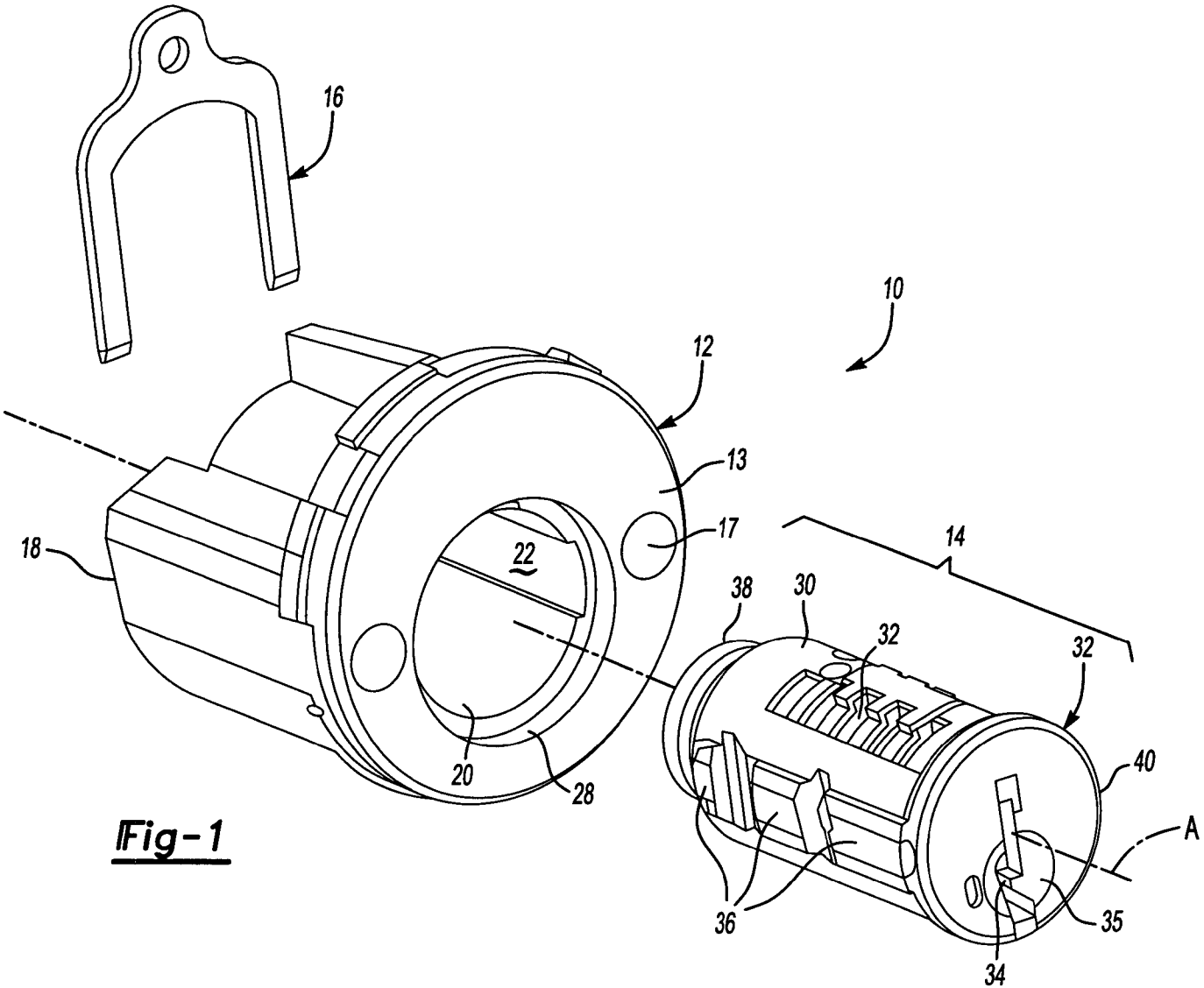
FIG. 1 is a front exploded view of a lock assembly according to the present invention.

FIG. 1 illustrates a general exploded perspective view of a lock assembly 10. The lock assembly generally includes a housing 12, a core assembly 14 and a retainer 16. It should be understood that although a particular component configuration is disclosed in the illustrated embodiment, other arrangements will benefit from the instant invention.

The housing 12 includes a front face 13 and a rear face 18. It should be understood that relative positional terms such as "forward," "aft," "upper," "lower" "above," "below," and the like are with reference to the normal operational attitude and should not be considered otherwise limiting. A longitudinally extending bore 20 opens through the front and rear faces 13, 18 and defines an axis A. Elongate, open-ended grooves 22 are formed within the bore 20 generally parallel to the axis A. The grooves 22 are preferably open through the front and rear face 13, 18 and are parallel to axis A. A counter born 28 within the front face 35 extends about the periphery of the bore 20.

The core assembly 14 includes a barrel 30 and a rotatable lock core 32. A keyway 34 is defined in a front face 35 of the lock core 32 to permit insertion of a key such that the lock core 32 can be rotated to operate the lock. Operation of the key to pin arrangement may take various conventional forms and need not be described in detail herein.

A core assembly extension 36 extends from the core assembly 14. The extension 36 is preferably formed as a portion of the barrel 30 to engage the grooves 22 to prevent relative rotation of the housing 12 and core assembly 14. The extension 36 also assists in guiding the core assembly 14 into the bore 20. The extension 36 may be formed in one or more portions to preferably form a rail structure along the longitudinal length of the core assembly 14. It should be understood that various extension shape and arrangements will benefit from the present invention.

An actuating member 24 is located within a rear portion 38 of the lock core 32 (FIG. 2) to engage an actuating plate (not shown) that extends through a latch bolt (not shown), which is conventional and need not described in detail herein.

A circumferential flange 40 (FIG. 2) is received within the recessed face 28 to control the axial insertion depth of the core assembly 14 into the housing 12.

Figure 2:
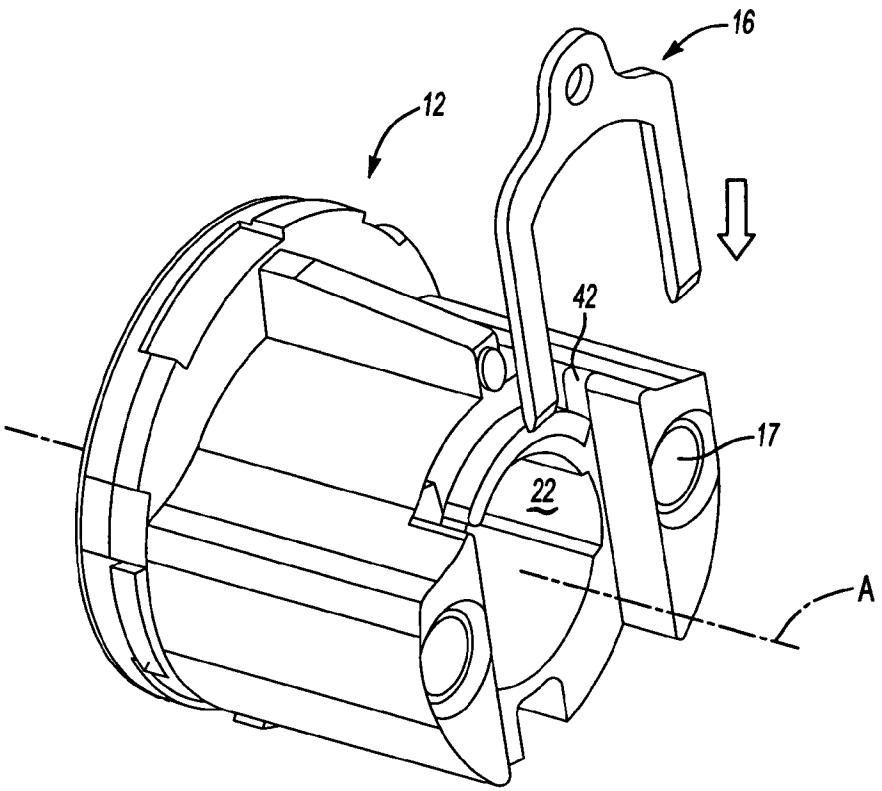
FIG. 2 is a rear exploded view of a lock assembly according to the present invention.
Figure 2:
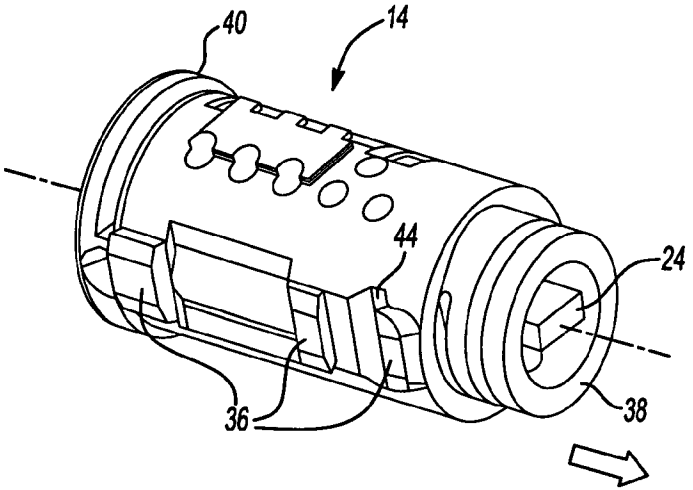

Referring to FIG. 2, the housing 12 includes a housing retainer groove 42 located generally transverse to the axis A. The housing retainer groove 42 corresponds with a core assembly retainer groove 44, which is located transverse to axis A. The core assembly retainer groove 44 is preferably formed transversely through the extension 36.

When the core assembly 14 is mounted within the bore 20, the retainer grooves 42, 44 are aligned (FIG. 4) through interaction of the circumferential flange 40 and the counter bore 28. That is, the core assembly 14 is pushed into the bore 20 until the circumferential flange 40 engages the counter bore 28 such that the retainer grooves 42, 44 are aligned.

Figure 3:
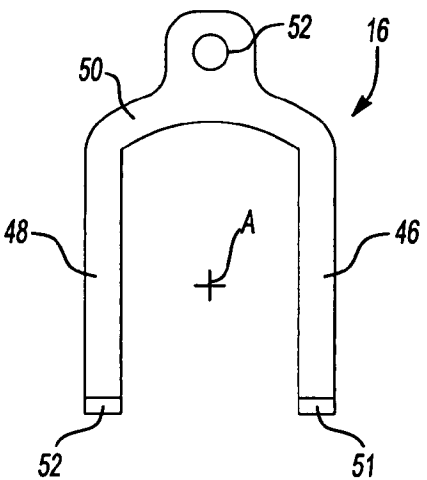
FIG. 3 is a planar view of a retainer.
Figure 5:
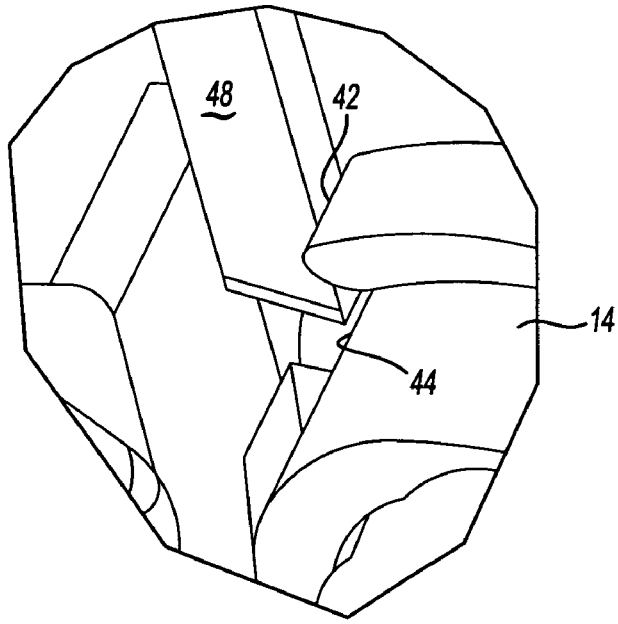
FIG. 5 is an expanded view of FIG. 4.

Referring to FIG. 3, the retainer 16 is preferably formed as a generally flat U-shaped member. It should be understood that other shapes will also benefit from the present invention. The retainer 16 includes a first leg 46, a second leg 48 and a bridge portion 50 therebetween. Each leg 46, 48 preferably include a bevel 51 at the end thereof to assist installation of the retainer 16 into the groove 42, 44 (FIG. 5). The bridge portion 50 preferably includes an aperture 52.

Figure 4:
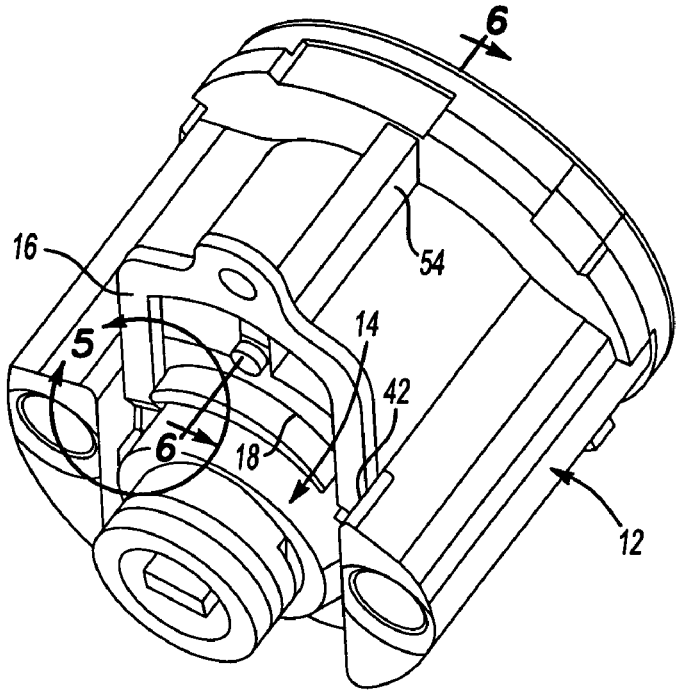
FIG. 4 is a rear perspective view of a lock assembly according to the present invention with the retainer partially installed.

Referring to FIG. 4, the retainer 16 is partially inserted into the retainer grooves 42, 44 such that the bridge portion 50 is just above a retainer engagement feature 54. The retainer engagement feature 54 is preferably formed along a top portion of housing 12 and extends toward the rear face 18 thereof.

Figure 6:
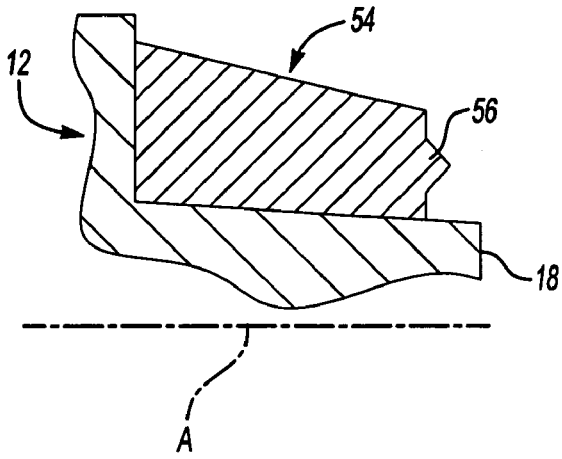
FIG. 6 is a sectional view of a retainer engagement member.

Referring to FIG. 6, the retainer engagement feature 54 includes a detent 56. The detent 56 is located parallel to axis A.

Figure 7:
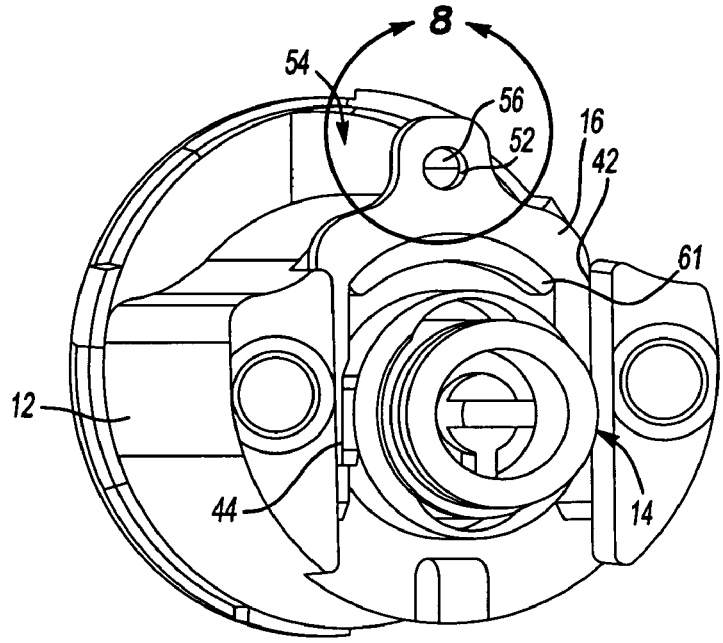
FIG. 7 is a rear perspective view of a lock assembly according to the present invention with the retainer installed.
Figure 8:
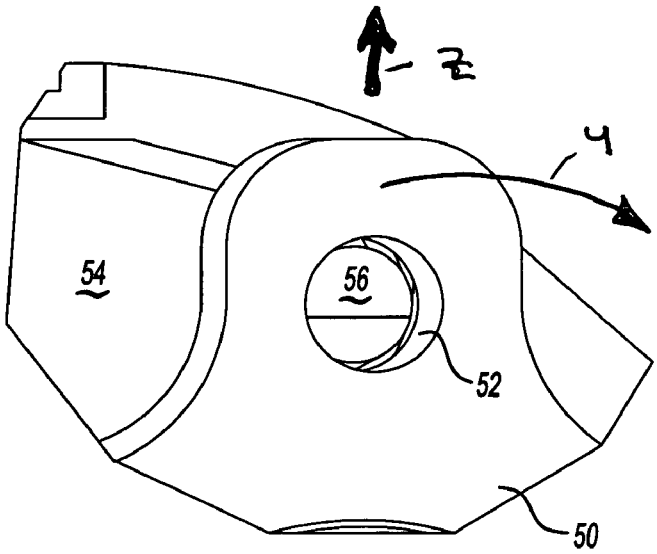
FIG. 8 is an expanded view of FIG. 7.

Referring to FIG. 7, as the retainer 16 is pushed into the grooves 42,44, the bridge portion of the retainer 16 engages the detent 56. The unique wedgeshape (FIG. 6) of detent 56 allows the bridge portion 50 of the retainer 16 to slide into position, resting on feature 61. The retainer 16 is pushed into the retainer grooves 42, 44 until the aperture 52 is aligned with the detent 56. When the aperture 52 is aligned with the detent 56, detent 56 secures retainer 16 into the retainer grooves 42, 44 and thereby mounts the core assembly 14 within the housing 12. To remove the core assembly 14, the bridge retainer 16 is angled (illustrated schematically by arrow Y), then lifted at an angle (illustrated schematically by arrow Z), allowing aperture 52 to clear detent 56, and the retainer 16 is removed.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A lock assembly comprising:

a housing which defines an axis, said housing including a retainer engagement feature extending from said housing and a housing retainer groove;

a core assembly receivable within said housing along said axis; and a retainer having a first leg, a second leg and a bridge portion between said first leg and said second leg, said bridge portion having an aperture located there through, said retainer engageable with said housing retainer groove at an angle not perpendicular to said axis to initially pass over said retainer engagement feature extending from said housing during insertion of the retainer into the housing retainer groove and said core assembly transverse said axis to retain said core assembly within said housing said retainer engagement feature is engageable with said aperture to retain said retainer within said housing.

2. The lock assembly as recited in claim 1, wherein said retainer engagement feature comprises an angled detent.

3. A front loading lock assembly comprising:

a housing which defines an axis, said housing including a retainer engagement feature extending from said housing;

a core assembly receivable within said housing along said axis, said core assembly comprising a flange which engages said housing to locate said core assembly at a predetermined distance along said axis; and a retainer having a first leg, a second leg and a bridge portion between said first leg and said second leg, said bridge portion having an aperture located there through, said retainer engageable with said housing and said core assembly to retain said core assembly within said housing, said retainer receivable with a housing retainer groove at an angle not perpendicular to said axis to initially pass over said retainer engagement feature during insertion of the retainer into the housing retainer groove and a core assembly retainer groove transverse said axis wherein said retainer engagement feature is engageable with said aperture to retain said retainer within said housing.

4. The front loading lock assembly as recited in claim 3, wherein said retainer engagement feature comprises an angled detent.

5. A method of mounting a core assembly within a housing of a lock assembly comprising the steps of:

(a) inserting the core assembly within a bore in the housing along an axis;

(b) aligning a housing retainer groove and a core assembly retainer groove;

(c) inserting a retainer into the housing retainer groove to initially pass over a retainer engagement feature extending from the housing during insertion of the retainer into the housing retainer groove and the core assembly retainer groove transverse the axis; and (d) selectively securing the retainer to the housing by biasing an engagement detent extending from the housing at least partially through an aperture in the retainer.

6. A lock assembly comprising:

a housing which defines an axis, said housing including a retainer engagement feature;

a core assembly receivable within said housing along said axis; and a retainer engageable with said housing and said core assembly transverse said axis to retain said core assembly within said housing, said retainer includes a first leg, a second leg and a bridge portion between said first leg and said second leg, said bridge portion including an aperture engageable with said retainer engagement feature to retain said retainer within said housing.

7. A front-loading lock assembly comprising:

a housing which defines an axis, said housing including a retainer engagement feature;

a core assembly receivable within said housing along said axis, said core assembly comprising a flange which engages said housing to locate said core assembly at a predetermined distance along said axis; and a U-shaped retainer engageable with said housing and said core assembly to retain said core assembly within said housing, said retainer receivable with a housing retainer groove and a core assembly retainer groove transverse said axis, said retainer includes a first leg, a second leg and a bridge portion between said first leg and said second leg, said bridge portion including an aperture engageable with said retainer engagement feature to retain said retainer within said housing.

8. A method of mounting a core assembly within a housing of a lock assembly comprising the steps of:

(a) inserting the core assembly within a bore in the housing along an axis;

(b) aligning a housing retainer groove and a core assembly retainer groove;

(c) inserting a retainer into the housing retainer groove and the core assembly retainer groove transverse the axis; and (d) selectively securing the retainer to the housing by biasing an engagement detent extending from the housing at least partially through an aperture in the retainer.

9. A lock assembly comprising:

a housing which defines an axis, said housing including a retainer engagement feature extending from said housing and a housing retainer groove, wherein said retainer engagement feature extending from said housing extends parallel to said axis;

a core assembly receivable within said housing along said axis; and a retainer engageable with said housing retainer groove to initially pass over said retainer engagement feature extending from said housing during insertion of the retainer into the housing retainer groove and said core assembly transverse said axis to retain said core assembly within said housing.

10. A front-loading lock assembly comprising:

a housing which defines an axis, said housing including a retainer engagement feature extending from said housing, wherein said retainer engagement feature extending from said housing extends parallel to said axis;

a core assembly receivable within said housing along said axis, said core assembly comprising a flange which engages said housing to locate said core assembly at a predetermined distance along said axis; and a retainer engageable with said housing and said core assembly to retain said core assembly within said housing, said retainer receivable with a housing retainer groove to initially pass over said retainer engagement feature during insertion of the retainer into the housing retainer groove and a core assembly retainer groove transverse said axis.

* * * * *